United States Patent [19]

Porter et al.

[11] 4,382,809

[45] May 10, 1983

[54] METHOD AND APPARATUS FOR THE PRODUCTION OF MINERAL FIBER FELTS HAVING FIBER-LEVELING DEVICE

[75] Inventors: William F. Porter, Lake Zurich, Ill.; Shirley J. Schwab, Tacoma; Karl E. Schneider, Auburn, both of Wash.

[73] Assignee: United States Gypsum Company, Chicago, Ill.

[21] Appl. No.: 333,208

[22] Filed: Dec. 21, 1981

[51] Int. Cl.[3] ..... C03B 37/01

[52] U.S. Cl. ..... 65/4.4; 65/9; 156/62.2; 156/62.4

[58] Field of Search ..... 65/4.4, 9; 156/62.2, 156/62.4

[56] References Cited

U.S. PATENT DOCUMENTS

| | | | |
|---|---|---|---|
| 1,948,395 | 2/1934 | Powell | 65/9 |
| 2,863,493 | 12/1958 | Snow et al. | 156/62.4 |
| 3,158,668 | 11/1964 | Johnson | 156/62.4 X |

FOREIGN PATENT DOCUMENTS

| | | | |
|---|---|---|---|
| 663689 | 5/1979 | U.S.S.R. | 65/4.4 |

*Primary Examiner*—Robert L. Lindsay, Jr.
*Attorney, Agent, or Firm*—Samuel Kurlandsky; Robert M. Didrick; Robert H. Robinson

[57] ABSTRACT

An apparatus for the production of mineral fiber or wool felts, blankets or batts having uniform thickness and density, comprising means for fiberizing the mineral composition, a housing defining a chamber into which the fibers are introduced, a foraminous belt upon which the fibers are deposited, a rotating brush for sweeping or throwing back excess fibers, thereby leaving a uniform layer of uncompressed fibers on the felt, and a roller for compressing the layer of fibers into a felt. The rotary brush removes the excess fibers and cooperates to provide a felt which is of uniform density and thickness.

8 Claims, 6 Drawing Figures

METHOD AND APPARATUS FOR THE PRODUCTION OF MINERAL FIBER FELTS HAVING FIBER-LEVELING DEVICE

BACKGROUND OF THE INVENTION

1. Field of the Invention

The present invention relates to an apparatus for the production of mineral fibers and felts formed from the mineral fibers, and more particularly refers to such an apparatus which can produce mineral fiber felts of uniform thickness and density.

2. Description of the Prior Art

It has been conventional in the prior art to produce glass and mineral wool fibers by conveying a stream of molten material such as glass or slag onto a rotating surface. The molten material is thereby centrifuged into the path of a high velocity stream formed of superheated steam, the centrifuged material originally in the form of finely divided molten streams is blasted by the steam and formed into solidified material of fibrous form. Among the patents which disclose this method are U.S. Pat. Nos. 2,869,175, 2,944,284, 3,013,299 and 3,022,538. However, the processes disclosed using steam were not completely satisfactory, since, the relatively high velocity and impact force of steam caused an undesirable attenuation and severance or breakage of the mineral fibers, thereby reducing the efficiency of the apparatus and the quality of the finished product. Moreover, the use of steam required rotor speeds of the centrifugal apparatus to be kept within critical limits in order to obtain filaments of a desired diameter. For example, where speed of the rotating disc was too high, the secondary attenuation produced thereby resulted in loose fibers which were too thin and fragible for normal use. Further, the fibers produced were of extremely short length and did not assume the structure of elongated threads or fibers. In order to overcome the deficiencies of steam operated fiberizing equipment, a method and apparatus were disclosed in U.S. Pat. No. 2,882,552 for using compressed air of low pressure to avoid the undesirable effects resulting from the use of high pressure steam. In the use of compressed air an advantage was realized in that no secondary attenuating defects were realized and the tendency to break or sever the filaments into short lengths was eliminated. However, the method and apparatus disclosed in that patent were not as efficient as desired and the quality of the mineral wool produced still left something to be desired with respect to the quality and the surface uniformity and smoothness of the finished fibers. Moreover, the apparatus disclosed in the patent is awkward to load and difficult to operate. The apparatus takes a lot of attention, is erratic, produces low yield and a high ratio of shot to fibers.

In U.S. Pat. No. 4,106,921 there is disclosed an apparatus for the production of mineral fibers utilizing compressed air and which apparatus can provide excellent mineral fibers of improved quality and at a reduced cost.

It has been conventional in the formation of felts, batts, or blankets of mineral fibers to deposit the formed fibers on a conveyor belt to form a layer of fibers. The layer is then moved to a rolling station where the fibers are compressed into the batts, blankets or felts. However, although the roll assembly insures that a felt or blanket of uniform thickness will be produced, because the fibers are not always piled on the belt to the same height or thickness, where the thickness of uncompressed fibers is greatest, the resulting density will be greater than that of the areas where the fibers are not piled as high.

SUMMARY OF THE INVENTION

It is accordingly an object of the present invention to provide an apparatus for the fiberization of mineral fibers. It is further an object of the invention to provide an apparatus which takes the formed fibers and forms them into a felt, blanket or batt.

It is still a further object to provide an apparatus of the type described which forms felts, blankets or batts of fibers of uniform thickness.

It is a prime object of the invention to provide an apparatus and method for the formation of felts, blankets or batts which are of uniform thickness and uniform density throughout.

Other objects and advantages of the invention will become apparent upon reference to the drawings and details of the description.

According to the invention, an apparatus for the production of felts, blankets or batts of mineral fibers is provided comprising a means for producing mineral fibers from mineral material, a conveyor belt on which the fibers are deposited in a non-uniform layer and which conveys the layer of fibers toward a roller station, and a rotating leveling brush for leveling the oncoming pile of fibers by throwing excess fibers rearwardly before the layer of fibers reaches the compression roller, so that a uniform thickness of fibers will be presented to the roller. After compression rolling, the resulting felt, blanket or batt is of excellent quality, having more uniform thickness and density throughout.

DESCRIPTION OF THE PREFERRED EMBODIMENT

Figure 1:
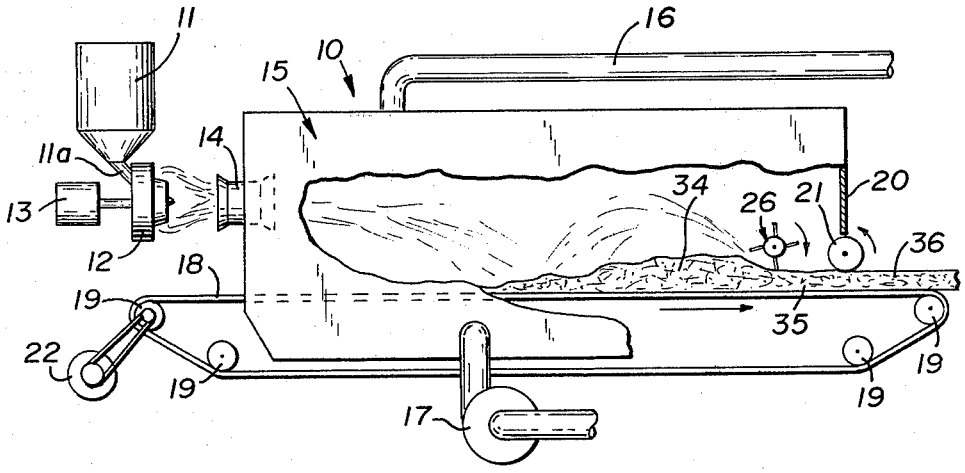
FIG. 1 is a side elevational view, partly in cross-section of an apparatus according to invention.

Referring to FIG. 1, an apparatus 10 for making mineral wool felts or blankets is shown. The apparatus comprises a heated container 11 having a supply of molten mineral material and having a duct 11*a* directing a stream of molten mineral material to a fiberizer 12, similar to that disclosed in U.S. Pat. No. 4,106,921. The wheel of the fiberizer is rotated by a motor 13. The formed fibers are blown into a collecting tube 14 having flared ends or lips, into a closed housing defining a chamber 15. A duct 16 for recycling the fiber back to the chamber 15 from a forward position is shown but is optional and need not be used. A blower 17 and duct provides a suction down draft to cause the mineral fibers to be deposited on a foraminous endless belt 18, and mounted on rollers 19 and operated by a motor 22. The forward wall 20 of the housing defining chamber 15 has an opening, with a compression roller 21 rotatably mounted in the opening and driven by a motor (not shown) for rolling the formed mineral wool layer to provide a felt of uniform surface and thickness.

According to the invention as shown in FIGS. 1–4, a felt skimmer or felt leveling brush assembly 26 is shown rotatably mounted in the chamber 15 of the housing. As shown particularly in FIGS. 3, 4, 5 and 6, the brush comprises a hollow shaft 27 over which are mounted a plurality of spaced-apart intermediate discs 28 and terminal discs 29. A plurality of pipes 30 are longitudinally mounted on the edges of the discs 28 and 29. The ends of the pipes 30 abut against the terminal discs 29 and are recessed in notches 31 in the intermediate discs 28. The pipes may be welded to the discs.

Figure 5:
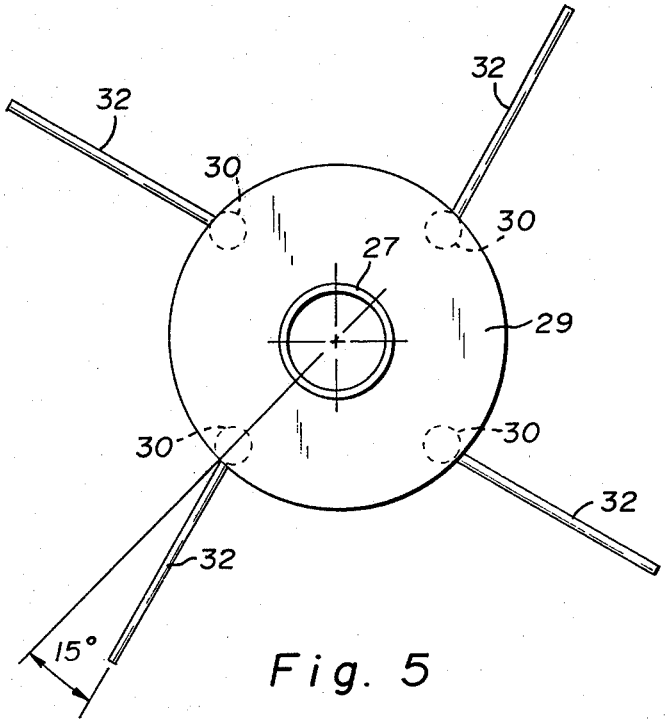
FIG. 5 is an end view of cylindrical leveling brush according to the invention.
Figure 6:
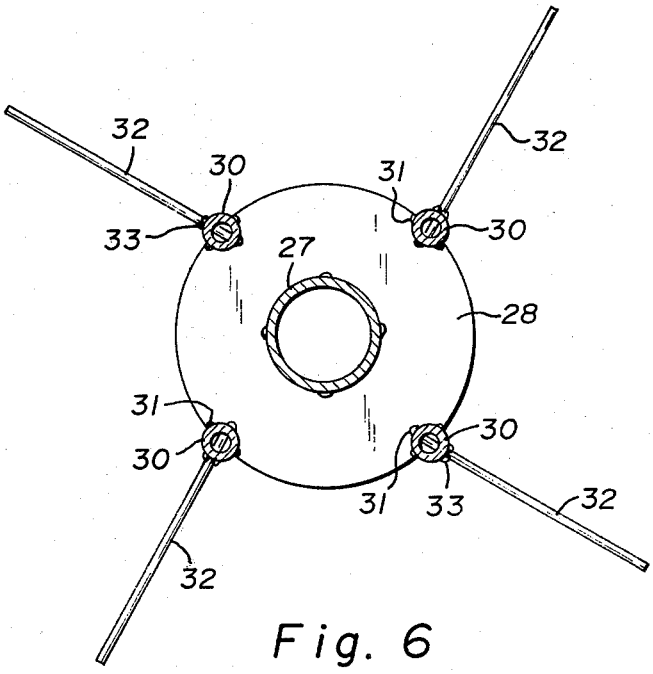
FIG. 6 is a view partly in cross-section taken at the line 6—6 of FIG. 4.

Referring particularly to FIGS. 5 and 6, a plurality of tines 32 are shown having their ends extending through holes 33 provided in the pipes 30 and welded thereto. The tines 32 are formed of spring metal such as steel and are advantageously positioned at a slight acute angle of about 15° with respect to the diameter of the shaft 27 and discs 28 and 29 so that they are somewhat swept-back with respect to the direction of rotation, as shown in FIG. 5. A motor 37 drives the brush assembly by means of an endless belt 38 mounted on pulleys 39 and 40.

Figure 2:
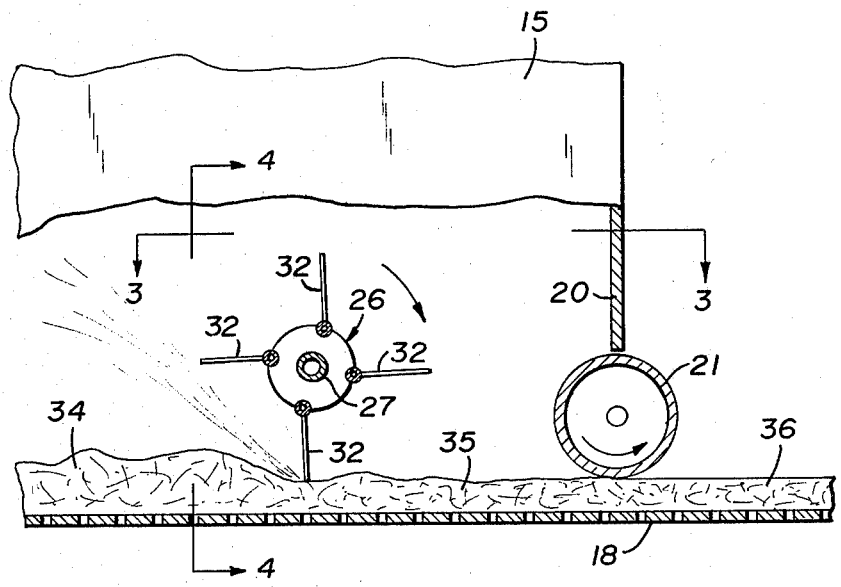
FIG. 2 is a fragmentary enlarged side elevational view of a portion of the apparatus shown in FIG. 1.
Figure 3:
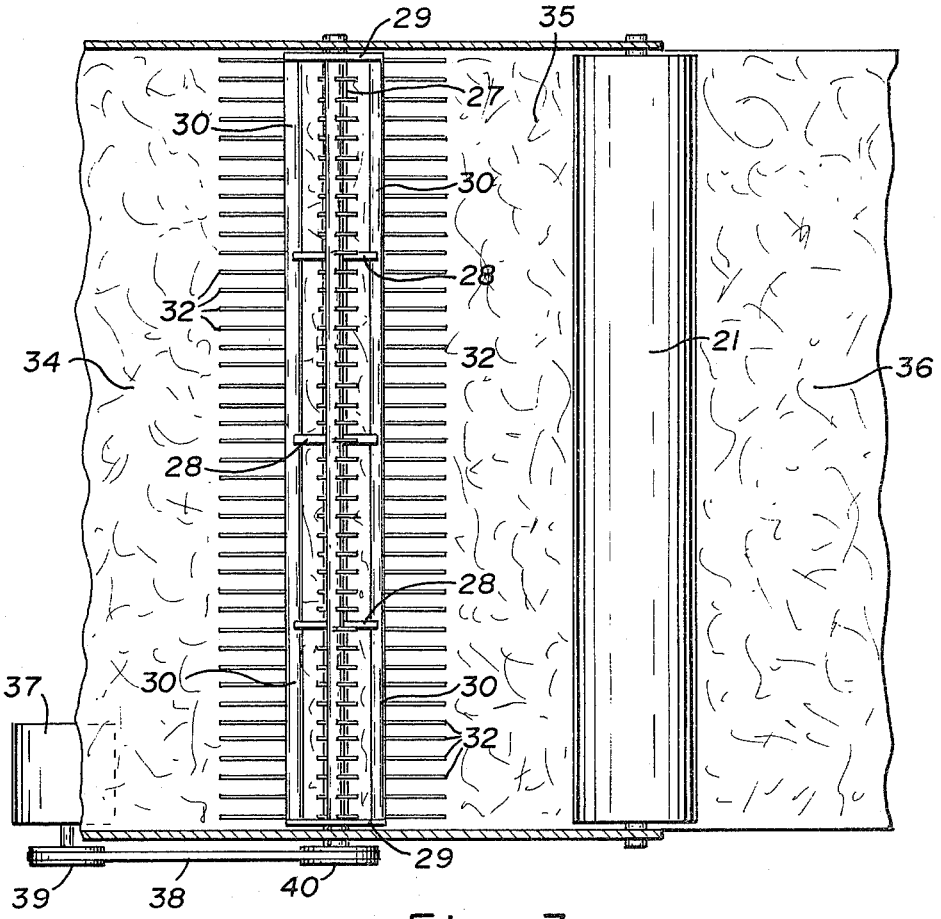
FIG. 3 is a fragmentary top sectional view taken at the line 3—3 of FIG. 2, looking in the direction of the arrows.
Figure 4:
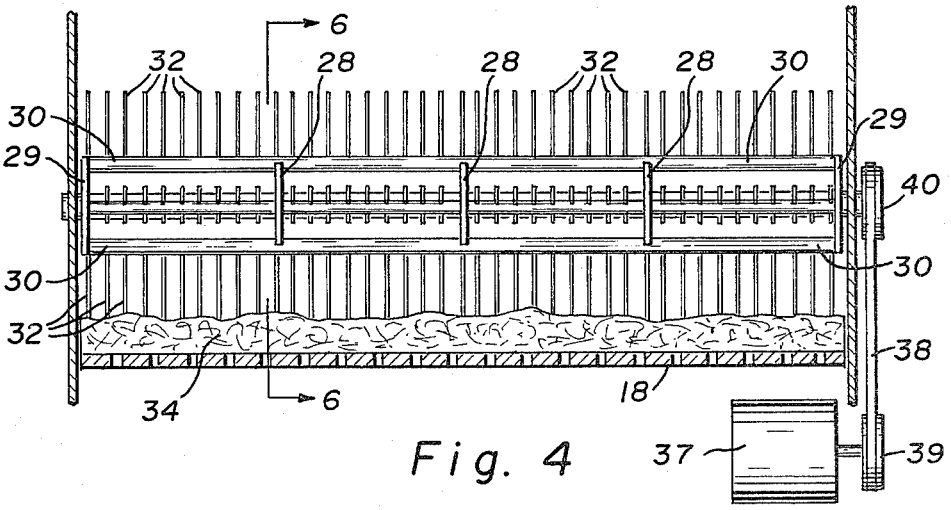
FIG. 4 is a cross-sectional view taken at the line 4—4 of FIG. 2, looking in the direction of the arrows.

Referring to FIGS. 1 and 2, the apparatus is shown in operation, forming mineral fibers and blowing the fibers into the chamber 15. The blower 17 creates a down draft and draws the fibers against the foraminous belt 18. The fibers are normally deposited in rather uneven layer having hills and valleys. In conventional apparatus which does not have the present skimmer brush 26 the uneven layer of mineral wool is passed beneath the compression roller 21 and the resulting felt is uniform in thickness. However, it was found that where the layer of the fiberous material is higher or in mounds, the density of the finished felt is greater in the originally high areas than in those areas where the pile of fibers was originally not as high. Consequently, the non-uniformity of the density of the finished felt renders it not desirable for many uses, in that it exhibits non-uniform heat insulation and additionally results in an increased cost per cubic foot of the finished felt.

In operating the present apparatus, the skimmer or leveling brush 26 is caused to rotate by the motor 37 in a direction such that the tines at the bottom move in a direction opposite to the direction of movement of the conveyor belt 18. The height of the brush is adjusted so that the ends of the tines are spaced above the belt a distance substantially equal to the thickness desired in the layer of felt 35 prior to compression. As a result, the hills of felt in the position of the layer designated by the numeral 34 are swept back toward the entrance portion of the chamber 15 and what is left is a thickness of mineral fibers 35 of substantially uniform height and without hills and valleys. Consequently, when the leveled blanket 35 passes under the compression roller 21, the resulting felt 36 is uniform in thickness and also in density.

The apparatus of the present invention for producing mineral fiber and forming mineral fiber felts has a number of advantages over apparatus of the prior art. First, the skimmer or leveling brush may be utilized in many different types of apparatus, such as those utilizing steam to fiberize the molten mineral material as well as those utilizing compressed air for that purpose. Most of the parts of the conventional apparatus may be used, and the leveling brush of the present invention may be readily installed in the chamber utilized for depositing the fiber on a conveyor belt. Through the use of the leveling brush, uniform levels of mineral wool may be obtained without the need for carefully controlling the amount introduced into the apparatus, since the excess represented in uneven piles deposited on the conveyor belt are scalped off leaving a blanket of uniform thickness. Consequently, after the blanket is passed under the compression roller 21, it results in a finished felt which is not only smooth and uniform in thickness but is also uniform in density. The leveling brush 26 can be constructed of readily available materials at low cost. It may be installed in any conventional apparatus utilized for forming mineral wool felts or blankets.

The mineral composition utilized in the present invention may be any of a plurality of conventional materials. One commonly used material is slag, which is a by-product of the metal industries. Another is basalt, a naturally occurring mineral. Prior to the fiberizing steps, the mineral material is heated to a temperature at which it exists in molten form of a low viscosity. The molten stream is then introduced into the fiberizing portion of the apparatus where the fibers are formed and subsequently deposited on the moving belt conveyor to be formed into felts.

It is to be understood that the invention is not to be limited to the exact details of construction or operation or materials shown and described, as obvious modifications and equilvalents will be apparent to one skilled in the art without departing from the spirit and scope of the invention.

Invention is claimed as follows:

1. In an apparatus for producing mineral wool felts, which apparatus comprises means for melting mineral material and converting said material into mineral fibers, means defining a chamber adapted to receive said fibers and having conveyor means therein for collecting said fibers in a layer and conveying said layer in a forward direction, and driven compression roller means for compressing and smoothing the surface of the layer to form a felt, the improvement which comprises a cylindrical leveling brush rotatably mounted in said chamber, said leveling brush comprising a frame and a plurality of tines each mounted at one end on said frame and extending therefrom to form said cylindrical brush, the lower surface of said cylindrical brush being spaced apart from the surface of said conveyor means at a predetermined distance equal to the desired thickness of said fiber layer before compression, said leveling brush being adapted to rotate in a direction in which excess mineral fibers are swept back toward the entrance of said chamber, thereby maintaining the thickness of said fiber layer prior to encountering said compression roller at a uniform predetermined value, and means for rotating said leveling brush, the finished felt after compression rolling having a uniform thickness and density.

2. An apparatus according to claim 1, wherein said leveling brush comprises a shaft operatively connected to said means for rotating said brush, a plurality of discs mounted on said shaft, a plurality of elongate tine-supporting members longitudinally positioned and affixed at the periphery of said discs, and a plurality of tines affixed to said tine-supporting members to form said cylindrical leveling brush.

3. An apparatus according to claim 2, wherein said tines are formed of spring steel.

4. An apparatus according to claim 2, wherein said tines are positioned in a swept back arrangement at an acute angle with respect to the diameter of said discs.

5. An apparatus according to claim 2, wherein said shaft is a pipe.

6. An apparatus according to claim 1, wherein said conveyor means comprises a motor driven endless foraminous conveyor belt, and vacuum-creating means mounted below said belt to draw fibers against the surface of said belt.

7. An apparatus according to claim 2, wherein said discs comprise a plurality of intermediate discs having said elongate tine-supporting members affixed to notches provided in the edges of said discs, and a terminal disc at each end of said brush having the ends of said tine-supporting members affixed to the flat surfaces of said discs at the periphery thereof.

8. A method for forming mineral fiber felts of uniform thickness and density which comprises melting mineral fiber-forming material, forming fibers from said material, depositing said fibers on a moving foraminous conveyor surface having vacuum creating means provided for drawing said fibers to said conveyor surface, brushing rearwardly the excess of mineral fibers on said conveyor above a predetermined height above the conveyor surface, to render the height of said preformed layer uniform, and passing said preformed and brushed layer under a compression roller to establish the final thickness of said felt.

* * * * *